US008960492B2

(12) United States Patent
Yeung

(10) Patent No.: US 8,960,492 B2
(45) Date of Patent: Feb. 24, 2015

(54) COIN-OPERATED GUMBALL MACHINE

(75) Inventor: Chi Yin Yeung, Hong Kong (HK)

(73) Assignee: Sweet N Fun Ltd., Hong Kong (HK)

( * ) Notice: Subject to any disclaimer, the term of this patent is extended or adjusted under 35 U.S.C. 154(b) by 525 days.

(21) Appl. No.: 13/068,896

(22) Filed: May 23, 2011

(65) Prior Publication Data

US 2012/0298687 A1 Nov. 29, 2012

(51) Int. Cl.
*G07F 11/62* (2006.01)
*G07F 11/44* (2006.01)

(52) U.S. Cl.
CPC ..... *G07F 11/44* (2013.01)
USPC ..... 221/24; 221/268

(58) Field of Classification Search
USPC ..... 221/24, 155, 191, 246, 263
See application file for complete search history.

(56) References Cited

U.S. PATENT DOCUMENTS 467,676 A 1/1892 Schneider
2,442,174 A 5/1948 May
5,443,179 A * 8/1995 Palmer et al. ..... 221/265
5,452,822 A * 9/1995 Haymond ..... 221/155
6,056,151 A 5/2000 Peery et al.
6,211,626 B1 4/2001 Lys
6,485,349 B1 11/2002 Snyder
6,551,183 B2 * 4/2003 Knox et al. ..... 453/18
D499,146 S * 11/2004 Liu et al. ..... D20/7
7,213,723 B2 5/2007 Schwarzli
D621,179 S * 8/2010 Biraghi ..... D6/450
7,766,145 B1 * 8/2010 Chang ..... 193/13

* cited by examiner

*Primary Examiner* — Gene Crawford
*Assistant Examiner* — Kelvin L Randall, Jr.
(74) *Attorney, Agent, or Firm* — Raymond Sun

(57) ABSTRACT

A gumball machine includes a gumball container that holds a plurality of gumballs, a neck portion coupled to the gumball container, the neck portion having a coin slot for receiving a coin, and a gumball dispensing assembly that releases a gumball from the gumball container when a coin is inserted into the coin slot. The gumball machine further includes an elongated housing having an upper end coupled to the neck portion, the housing holding coins that have been inserted through the coin slot. A base is coupled to the lower end of the housing and has a bottom portion that is seated on a surface. A spiral ramp has a mouth coupled to the neck portion, the spiral ramp connected around the housing for allowing a dispensed gumball to roll downwardly.

7 Claims, 4 Drawing Sheets

COIN-OPERATED GUMBALL MACHINE

BACKGROUND OF THE INVENTION

1. Field of the Invention

The present invention relates to gumball machines, and in particular, to a gumball machine that dispenses a gumball upon insertion of a coin.

2. Description of the Prior Art

Gumball machines have been popular novelty items for a long time. Children and adults alike have enjoyed dispensing a gumball from a spherical transparent container. Some gumball machines have even been provided with tracks along which the gumball can travel while being dispensed.

SUMMARY OF THE DISCLOSURE

It is an object of the present invention to provide a gumball machine that provides additional fun and novelty for the user.

In order to accomplish the objects of the present invention, the gumball machine according to the present invention includes a gumball container that holds a plurality of gumballs, a neck portion coupled to the gumball container, the neck portion having a coin slot for receiving a coin, and a gumball dispensing assembly that releases a gumball from the gumball container when a coin is inserted into the coin slot. The gumball machine further includes an elongated housing having an upper end coupled to the neck portion, the housing holding coins that have been inserted through the coin slot. A base is coupled to the lower end of the housing and has a bottom portion that is seated on a surface. A spiral ramp has a mouth coupled to the neck portion, the spiral ramp connected around the housing for allowing a dispensed gumball to roll downwardly along its path.

DETAILED DESCRIPTION OF THE PREFERRED EMBODIMENTS

Figure 1:
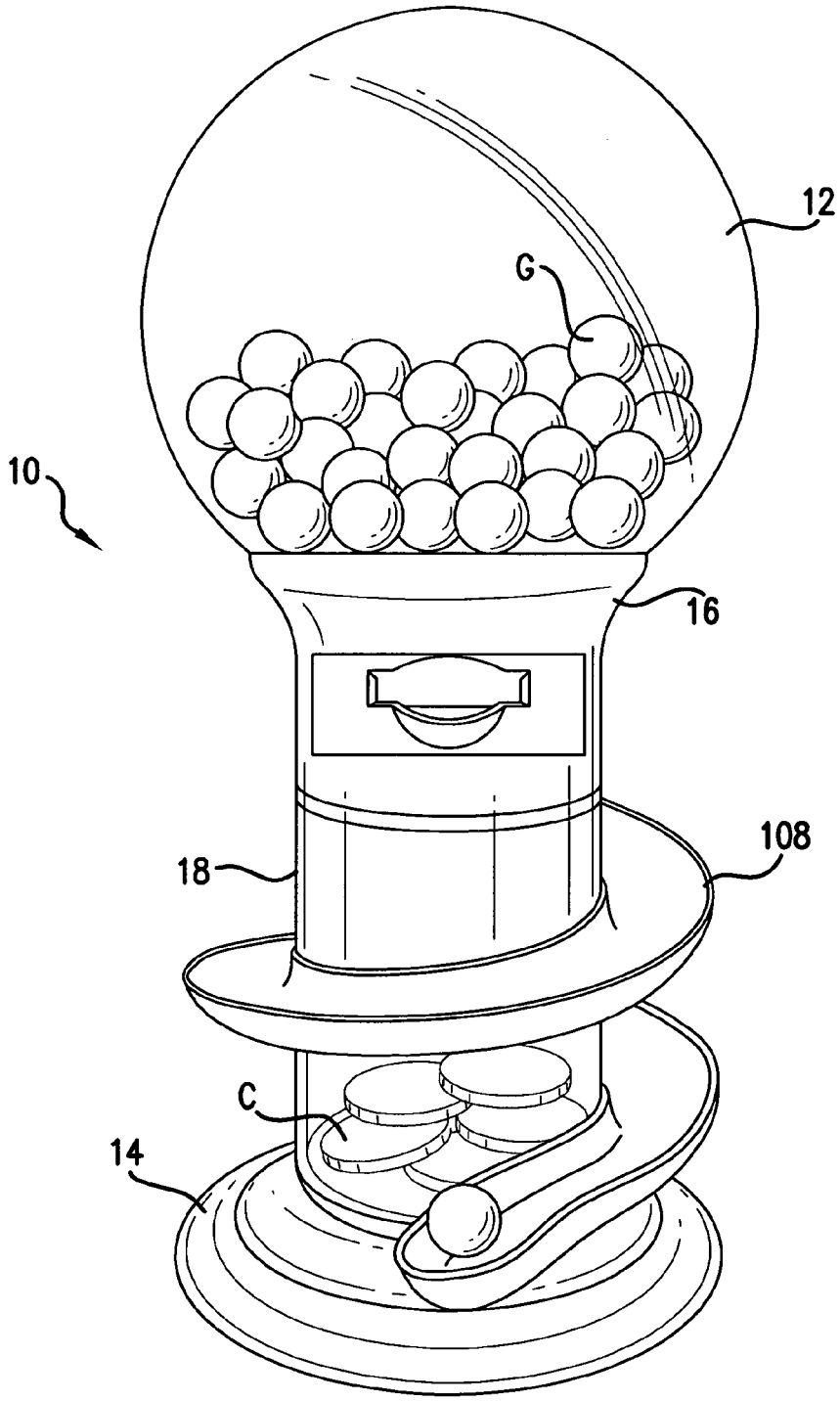
FIG. 1 is a perspective view of a gumball machine according to the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Referring to FIGS. 1-4, the gumball machine 10 of the present invention has a gumball container 12, a base 14, a neck portion 16 secured to the bottom of the gumball container 12, and a transparent cylindrical support housing 18 positioned between the neck portion 16 and the base 14.

The gumball container 12 has a spherical housing 20 that can be made of a transparent material, such as plastic. Gumballs G are stored in the container 12. Even though the housing 20 is shown as being spherical in configuration, it can be provided in any desired shape or size, and can even be configured as an object (e.g., an animal, a cup, etc.). The neck portion 16 is secured to the gumball container 12, and includes a gumball dispensing assembly 36 that will be described below in connection with FIGS. 2-4. The housing 18 is cylindrical and transparent, has its upper end secured to the bottom portion of the shell portions 50 and 52 of the neck portion 16, and has its lower end secured to the base 14. The base 14 has an enlarged bottom section 30 that is adapted to be seated on the ground or a flat surface. The base 14 has a body 32 extending from the bottom section 30, and the body 32 can be provided in any desired configuration, such as in the curved stepped configuration shown in FIG. 1. A removable cover 34 is provided at an opening (not shown) in the base 14 to allow coins C that are stored in the transparent housing 18 to be removed.

Figure 2:
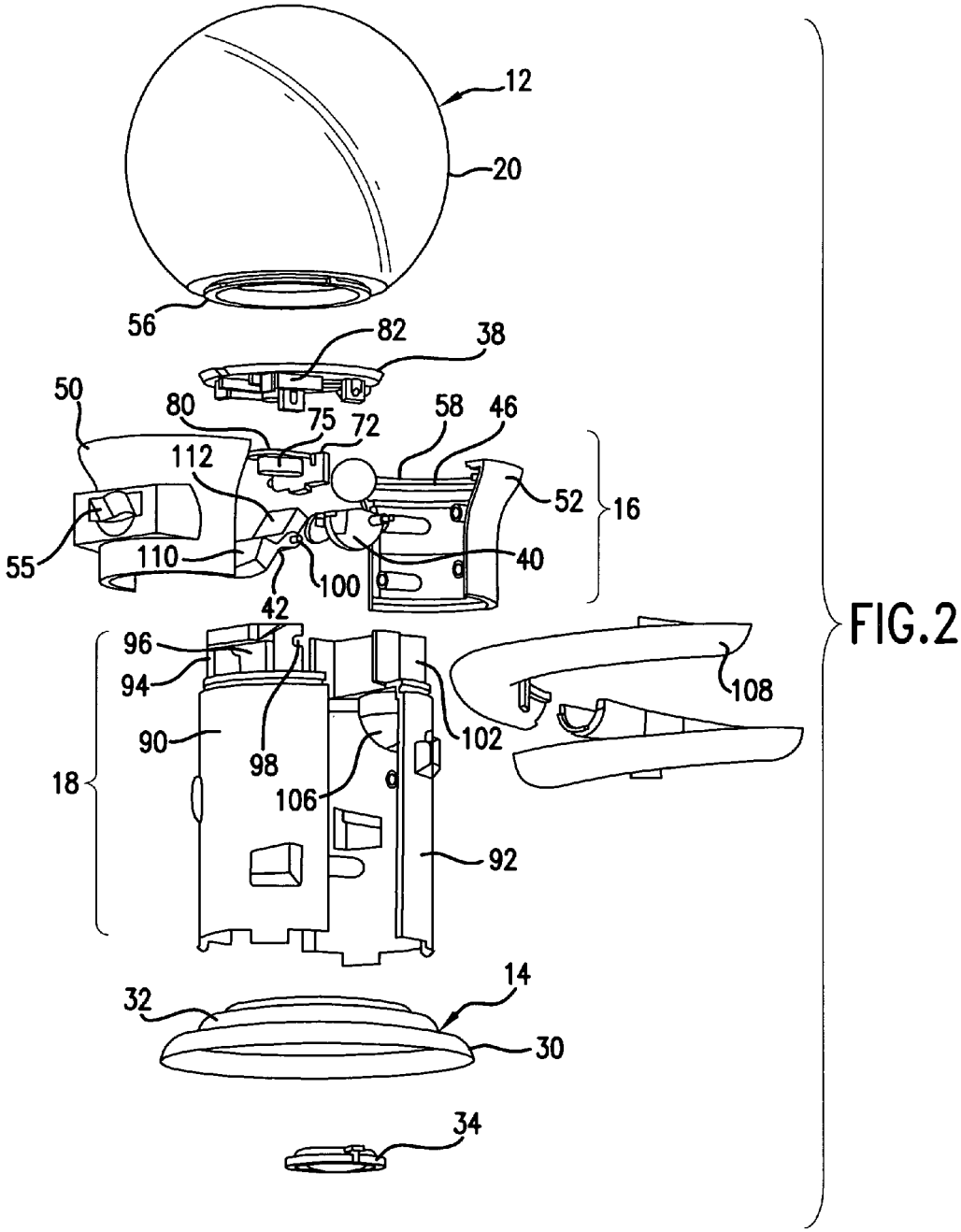
FIG. 2 is an exploded view of the gumball machine of FIG. 1.
Figure 3:
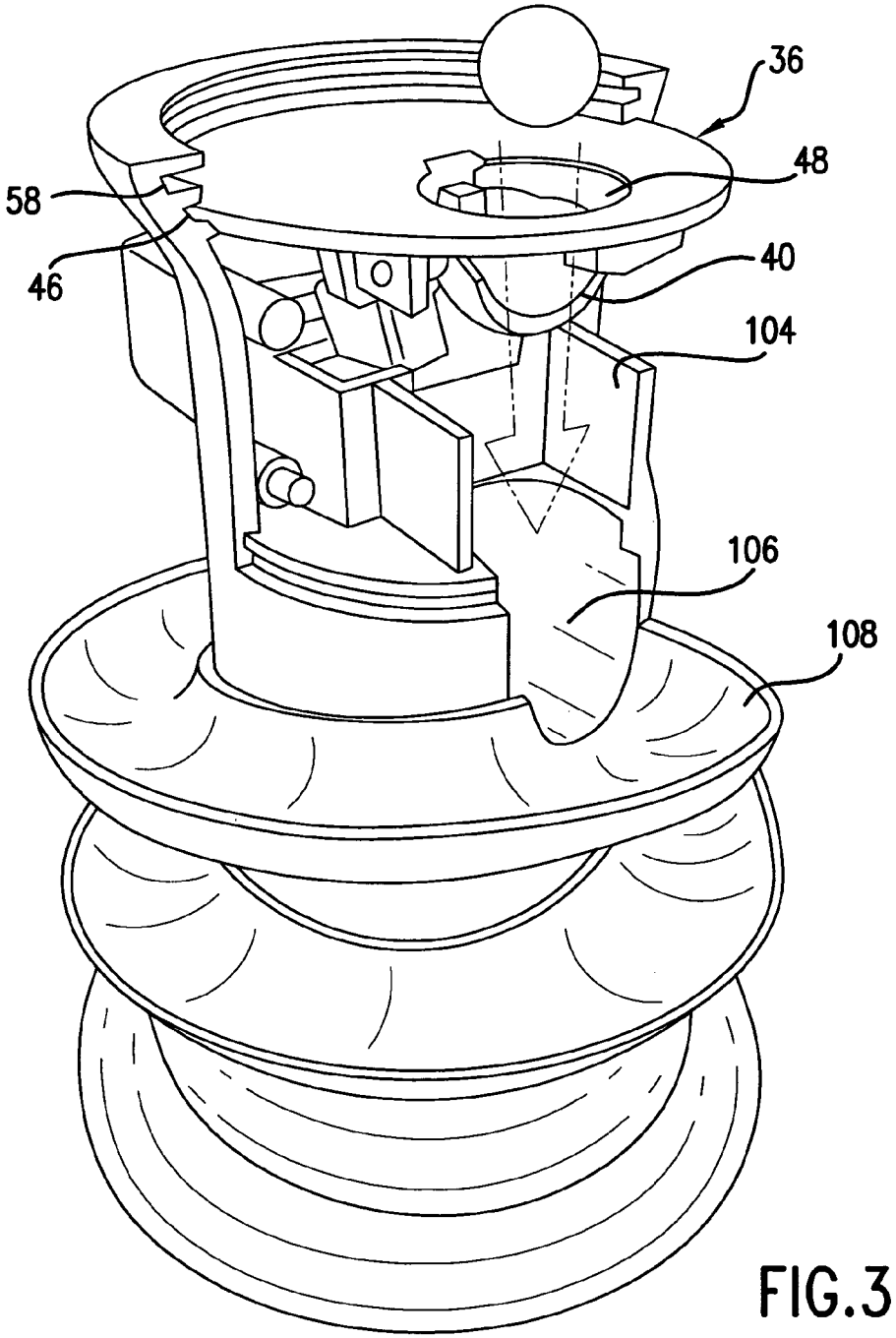
FIG. 3 is an enlarged view of part of the interior of the gumball machine of FIG. 1.
Figure 4:
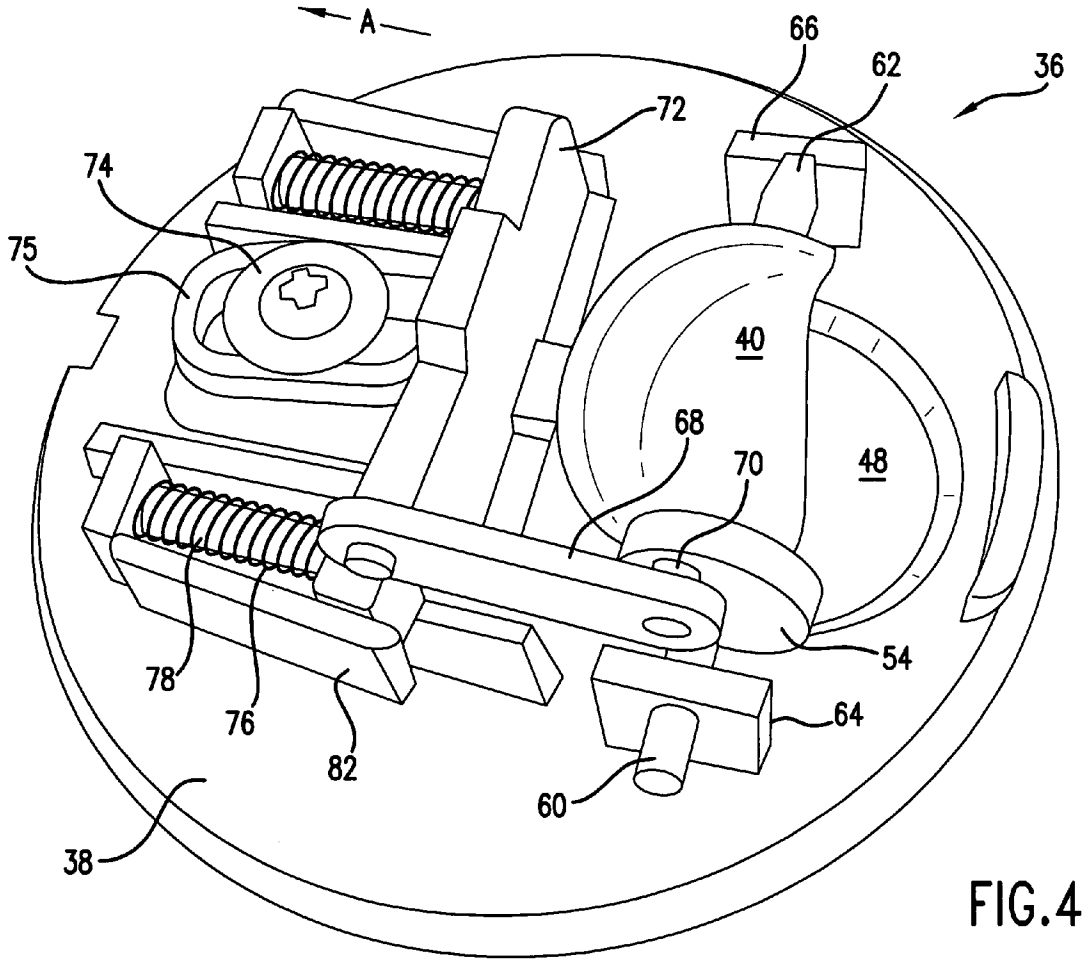
FIG. 4 is a bottom perspective view of the top plate of the gumball machine of FIG. 1.

Referring now to FIGS. 1 and 2, the neck portion 16 has two shell portions 50 and 52 that enclose the components of the gumball dispensing assembly 36. A coin slot or opening 55 is provided in the wall of the shell portion 50. The gumball container 12 has a flanged lower edge 56 that is adapted to be slidably received inside an annular shelf 58 of the shell portions 50, 52 to secure the gumball container 12 to the neck portion 16. The gumball dispensing assembly includes a top plate 38, a pivoting cup 40, a lever 42 and a pusher assembly. The top plate 38 separates the interior of the gumball container 12 from the interior of the neck portion 16, and is adapted to be slidably received inside a shelf 46 of the shell portions 50, 52, and has a circular opening 48 that allows a gumball from the gumball container 12 to pass therethrough via the force of gravity. Referring to FIGS. 2-4, the cup 40 has a hemispherical shape, and two shafts 60 and 62 extend outwardly from opposite sides to be pivotably coupled to posts 64 and 66. A cam 54 is connected to the cup 40 and is carried on the shaft 60. A link 68 is coupled (via another shaft 70) to the pushing wall 72 of the pusher assembly. The pusher assembly includes a base plate 80 that is mounted for reciprocal back-and-forth movement to the bottom surface of the top plate 38 via a screw 74 within a well 75, with the pushing wall 72 provided perpendicular to the base plate 80 at the front edge of the base plate. The pusher assembly also includes two elastic elements 76 (e.g., springs) that are received around corresponding rods 78 secured inside box frames 82 that are non-movably secured to the bottom surface of the top plate 38.

Referring now to FIGS. 2 and 3, the transparent housing 18 has two shell portions 90 and 92 that, when secured together, define the coin reservoir. A first support section 94 extends from the top of the shell portion 90, and includes a guide wall 96 positioned adjacent the coin slot 55 that is slightly offset from the shell portion 90 to define an opening (not shown) between the guide wall 96 and the shell portion 90 through which a coin may pass. Notches 98 are provided on the other side of the guide wall 96 for receiving pins 100 extending from either side of the lever 42. Thus, the pins 100 pivot about the axis defined by the notches 98 to allow the lever 42 to pivot about the guide wall 96. The lever 42 has a leg 110 and a head 112. The leg 110 is positioned adjacent the location of the coin slot 55, and normally blocks the opening between the guide wall 96 and the wall of the shell portion 90. The head 112 is positioned between the pushing wall 72 and the cup 40. A second support section 102 extends from the top of the shell portion 92, and has guide walls 104 that function to guide a gumball G into a receiving well 106. The receiving well 106 is connected to the mouth of a spiral ramp 108 that extends around the outer surface of the wall of the housing 18. The spiral ramp 108 begins at the location of the receiving well 106 and terminates adjacent the base 14, as shown in FIG. 1.

In operation, the user inserts a coin C into the coin slot 55. As the coin C passes through the coin slot 55, it pushes the leg 110 of the lever 42, causing the lever 42 to pivot. The pivoting of the lever 42 causes the head 112 to push the pushing wall 72 backwards (see arrow A in FIG. 4) against the natural bias of the elastic elements 76. As the pushing wall 72 moves rearwardly, the link 68 will move with the pushing wall 68 and pull the cam 54 to pivot in the counterclockwise direction (as viewed in the orientation shown in FIG. 4) to cause the cup 40 to pivot away from the opening 48. As shown in FIG. 3, when in a normal non-dispensing position, the cup 40 blocks the opening 48 from the receiving well 106. When the cup 40 is pivoted towards the direction of arrow A, the gumball G that had been sitting in the cup 40 is released into the receiving well 106, where the gumball G then travels down the spiral ramp 108 until it reaches the bottom of the ramp (see FIG. 1). After the coin C passes the leg 110, it passes through the opening between the guide wall 96 and the wall of the shell portion 90, and falls into the coin reservoir defined by the transparent housing 18. The housing 18 is transparent so that the collected coins can be viewed. The elastic elements 76 then naturally bias the pushing wall 72 back towards the cup 40, pushing the head 112 of the lever 42 to pivot the lever 42 so that the leg 110 is again adjacent the coin slot 55, and causing the link 68 to push the cam 54 to pivot the cam 54 in the clockwise direction (as viewed in the orientation shown in FIG. 4) to cause the cup 40 to pivot to block the opening 48. When the cup 40 blocks the opening 48, another gumball G will be received into the cup 40, and the gumball machine 10 will be ready for another coin to be inserted.

Thus, the present invention provides a gumball machine 10 which does not require actuation of a knob or switch to dispense a gumball. Rather, a gumball is dispensed automatically when a coin is inserted into the coin slot 55. The inserted coins are stored in the housing 18 and can be viewed from the outside. The coins can be removed by opening the cover 34.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A gumball machine, comprising:

a gumball container that holds a plurality of gumballs;

a neck portion coupled to the gumball container, the neck portion having a coin slot for receiving a coin, and a gumball dispensing assembly that automatically releases a gumball from the gumball container when a coin is inserted into the coin slot;

an elongated housing having an upper end coupled to the neck portion, and a lower end, the housing holding coins that have been inserted through the coin slot;

a base coupled to the lower end of the housing and having a bottom portion that is seated on a surface;

a spiral ramp having a mouth coupled to the neck portion, the spiral ramp connected around the housing for allowing a dispensed gumball to roll downwardly;

a top plate separating the interior of the gumball container and the neck portion, the top plate having an opening for allowing a gumball to pass through; and wherein the gumball dispensing assembly includes:

a pivoting cup positioned under the opening and holding a gumball;

a pushing wall coupled to top plate and the cup; and a lever having a leg positioned adjacent the coin slot and a head positioned adjacent the pushing wall in a manner such that a coin impacting the leg pivots the lever to cause the head of the lever to push the pushing wall to pivot the cup to release the gumball.

2. The machine of claim 1, wherein the base has an opening for accessing coins stored in the housing.

3. The machine of claim 2, wherein the housing is transparent.

4. The machine of claim 1, wherein the gumball dispensing assembly further includes an elastic element that normally biases the pushing wall to a first position, and wherein the head of the lever pushes the pushing wall to a second position against the normal bias of the elastic element.

5. A gumball machine, comprising;

a gumball container that holds a plurality of gumballs;

a neck portion coupled to the gumball container, the neck portion having a coin slot for receiving a coin, and a gumball dispensing assembly that releases a gumball from the gumball container when a coin is inserted into the coin slot;

a top plate separating the interior of the gumball container and the neck portion, the top plate having an opening for allowing a gumball to pass through;

an elongated housing having an upper end coupled to the neck portion, and a lower end, the housing holding coins that have been inserted through the coin slot;

a base coupled to the lower end of the housing and having a bottom portion that is seated on a surface; and a spiral ramp having a mouth coupled to the neck portion, the spiral ramp connected around the housing for allowing a dispensed gumball to roll downwardly;

wherein the gumball dispensing assembly includes:

a pivoting cup positioned under the opening and holding a gumball;

a pushing wall coupled to top plate and the cup;

an elastic element that normally biases the pushing wall to a first position; and a lever having a leg positioned adjacent the coin slot and a head positioned adjacent the pushing wall in a manner such that a coin impacting the leg pivots the lever to cause the head of the lever to push the pushing wall to a second position against the normal bias of the elastic element so as to pivot the cup to release the gumball.

6. The machine of claim 5, wherein the base has an opening for accessing coins stored in the housing.

7. The machine of claim 6, wherein the housing is transparent.

* * * * *